United States Patent [19]

Fujisawa

[11] 4,283,698

[45] Aug. 11, 1981

[54] MAGNET DEVICE FOR ANIMALS, IN PARTICULAR CATTLE

[76] Inventor: Yoshiho Fujisawa, I8-6, 3-chome Kichijoji Minami-cho, Musashino, Tokyo, Japan

[21] Appl. No.: 76,325

[22] Filed: Sep. 17, 1979

[30] Foreign Application Priority Data

Aug. 8, 1979 [JP] Japan ..... 54-109646[U]

[51] Int. Cl.[3] ..... H01F 7/02

[52] U.S. Cl. ..... 335/306; 335/302

[58] Field of Search ..... 335/302, 303, 305, 306; 210/222

[56] References Cited

U.S. PATENT DOCUMENTS

| | | | |
|---|---|---|---|
| 2,613,246 | 10/1952 | Spodig | 335/305 |
| 3,139,403 | 6/1964 | Cramer et al. | 210/222 |
| 3,206,657 | 9/1965 | Moriya | 335/303 |
| 3,376,529 | 4/1968 | Miyata | 210/222 |
| 3,462,720 | 8/1969 | Miyata | 335/305 |

*Primary Examiner*—George Harris

[57] ABSTRACT

A magnet device for collecting scrap irons in the stomach that which cattle have swallowed into the stomach. The magnet device is constituted by a plurality of magnets and at least a magnetic plate interposed therebetween.

6 Claims, 4 Drawing Figures

MAGNET DEVICE FOR ANIMALS, IN PARTICULAR CATTLE

BACKGROUND OF THE INVENTION

The present invention relates to a magnet device for animals, in particular cattle, and particularly to a magnet device adapted to be arranged in the stomach of cattle and to collect scrap iron pieces taken down in the stomach so that the scrap iron pieces are prevented from entering into the intestines.

Cattle grazing in meadows sometimes swallow grass nails, wires or the like falling on the ground. These scrap iron pieces remaining in the stomach are slightly dangerous for cattle, but when they enter into the intestines from the stomach, it causes a great danger which can be fatal to the cattle.

In order to prevent such a danger, there has been proposed a device which consists of a magnet formed in a bar or cylinder at a size to not enter into the intestines from the stomach and which is adapted to remain in the stomach of cattle thereby collecting scrap iron or the like invading into the stomach.

However, since such a device of a bar or cylinder magnet has magnetic pole portions limited to both end portions thereof, portion for performing a magnetizing function which collects the scrap irons is also limited to only both the end portions and its collecting effect has been insufficient.

In short, since the magnet device of this kind must remain in the stomach of cattle after the cattle has once swallowed it, without removing it out of the body of the cattle during its life, it was necessary to have the wide portion to magnetize scrap irons and to have a strong magnetizing force to magnetize the scrap irons.

The present invention is developed in the light of the above circumstances and in order to eliminate the above defects of the prior device, and contemplates to provide a magnet device which has the magnetizing portion not only at both ends but at peripheral wall portion and which has a magnetizing force intensified by concentrating flux of magnetic pole.

According to the present invention, a magnetic device is constituted by a plurality of magnets in a short cylinder shape having magnetic poles of polarity differing from each other at both end surfaces and piled in a longitudinal direction through the intermediary of at least a magnetic plate between each magnet, magnetic poles of the magnet opposing through the intermediary of the magnetic plate being the same polarity whereby the flux concentrates at the magnetic plate (yoke) portion and the magnetizing force increases.

Further, according to the invention, a magnet device is constituted by a plurality of magnets in a short cylinder shape having those outer diameter which are similar to or smaller than the outer diameter of magnetic plate, in order to decrease leakage flux and to effectively utilize the flux.

Other objects and features of the invention will appear in the following description taken with reference to the accompanying drawing.

DETAILED DESCRIPTION OF PREFERRED EMBODIMENT

Figure 1:
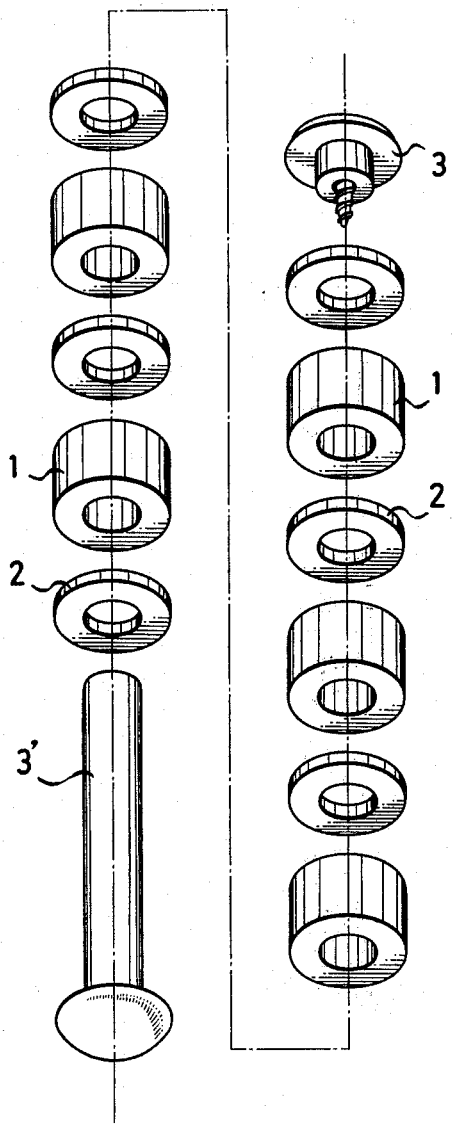
FIG. 1 is an exploded perspective view showing one embodiment of a magnetic device according to the invention.
Figure 2:
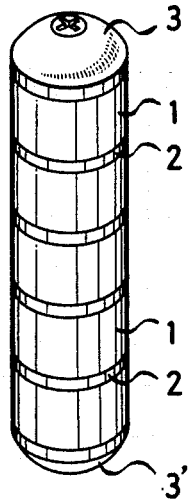
FIG. 2 is a perspective view showing a perfection of the embodiment in FIG. 1.
Figure 3:
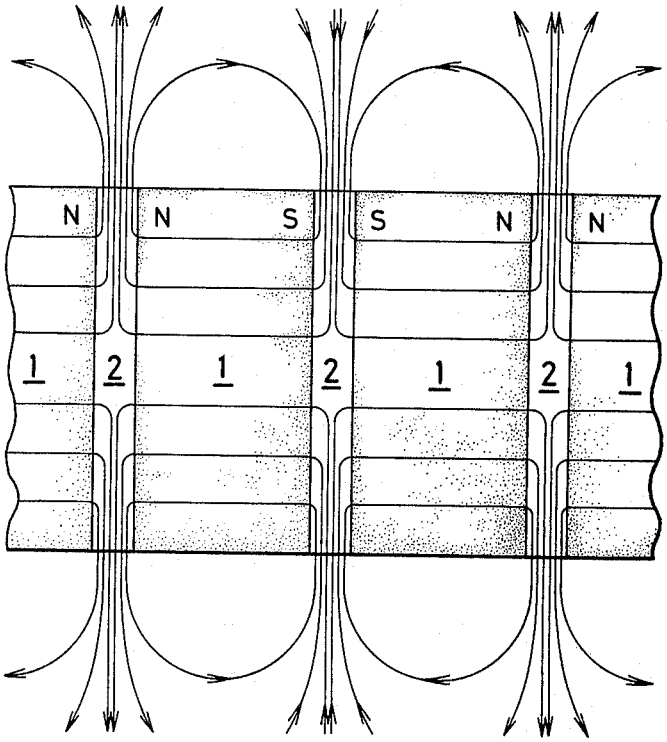
FIG. 3 is an explanatory view showing distribution of flux in the embodiment.

Referring to FIGS. 1 to 3, there is shown one embodiment according to the invention and magnets 1 in short cylinder shape are piled up through the intermediary of a magnetic plate 2 therebetween. Reference numerals 3 and 3' show insulating members of plastics covering both ends of the magnetic device so as to not hurt the inner wall of the stomach while the device is remaining in the stomach.

Further, magnetic material of ferrite is suitable for the magnet 1 of the short cylinder because the prior magnetic material of alnico is troublesome in its shaping.

In the magnet device according to the invention, its length is limited to a dimension which does not let it enter into the intestines from the stomach of cattle and as understood from distribution of flux shown in FIG. 3, the flux is concentrated at the end surface of the magnetic plate 2 and scrap iron attracted on the end surface. Consequently, it is desirable that the magnet 1 of the short cylinder is formed as thinly as possible and its number is increased, and that thickness of the magnetic plate 2 thickens to increase the magnetizing area. However, limitation exists on thining the magnet in relation to mechanical strength and also limitation exists on thickening the magnetic plate because concentration of the flux is rough according to the thickness of the magnetic plate to thereby decrease the magnetizing force.

Figure 4:
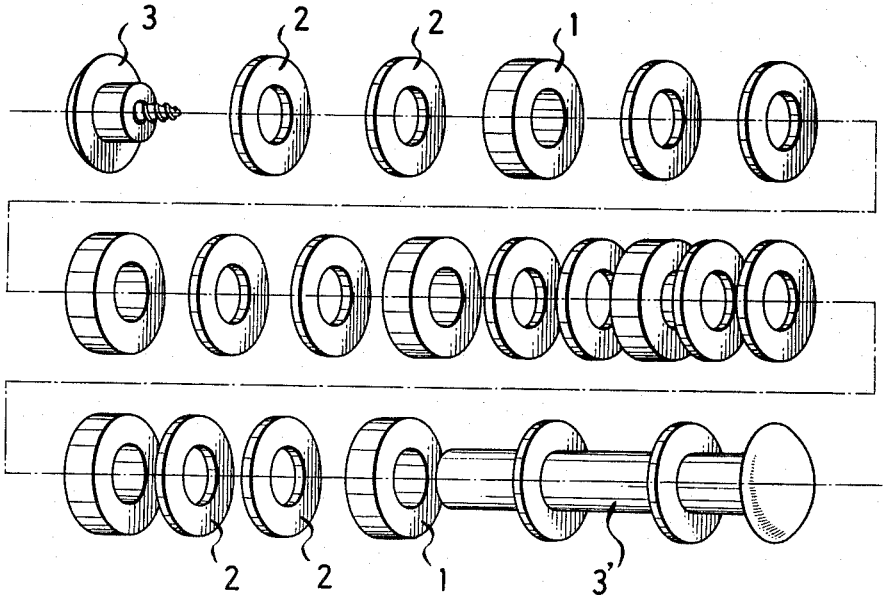
FIG. 4 is a perspective view showing the whole of another embodiment of a magnetic device according to the invention.

Referring to FIG. 4, there is shown another embodiment of the invention and thin magnets 1 are piled up through the intermediary of two magnetic plates 2 therebetween.

Function of each member is similar to that of the first embodiment, but its magnetizing area widens according to the two magnetic plates and the whole length of the magnet device can be adjusted by increasing and decreasing the number of the magnetic plates.

What is claimed is:

1. A magnetic device adapted to be ingested by an animal, the device comprising:

(a) a plurality of cylindrical magnets;

(b) a plurality of cylindrical magnetic spacers disposed between said magnets to form a longitudinal rod having a size which suffices to lodge the device in the stomach of the animal and not pass to the intestines, (c) said spacers and said magnets having essentially the same diameter and being arranged coaxially and adjacent to each other, said magnets being arranged such that the magnetic poles of the magnets confronting each other through the spacers are of the same polarity; and (d) two end pieces, one end piece being disposed at each end of the rod, said end pieces being generally semi-circularly shaped and having a diameter essentially the same as the diameter of said cylindrical magnets and spacers.

2. The device according to claim 1, wherein said cylindrical magnets and magnetic spacers are annularly shaped.

3. The device according to claim 2, further including a plastic rod disposed through the annularly shaped magnets and magnetic spacers, said plastic rod being affixed to said end pieces.

4. The magnetic device according to claim 3, wherein said end pieces are made of a plastic material and wherein one of said end pieces is formed integrally with said plastic rod.

5. The device according to claim 4 wherein said other of said end pieces is affixed to said plastic rod by means of a threaded fastener.

6. The device according to claims 1 or 5 wherein at least a pair of said magnetic spacers are disposed between each pair of confronting magnets.

* * * * *

US004283698B1

REEXAMINATION CERTIFICATE (1987th)

United States Patent [19]

Fujisawa

[11] B1 4,283,698

[45] Certificate Issued Apr. 27, 1993

[54] MAGNET DEVICE FOR ANIMALS, IN PARTICULAR CATTLE

[75] Inventor: Yoshiho Fujisawa, Tokyo, Japan

[73] Assignee: TMC Magnet Inc., Piscataway, N.J.

Reexamination Request:
No. 90/002,835, Sep. 11, 1992

Reexamination Certificate for:

| | |
|---|---|
| Patent No.: | **4,283,698** |
| Issued: | **Aug. 11, 1981** |
| Appl. No.: | **76,325** |
| Filed: | **Sep. 17, 1979** |

[30] Foreign Application Priority Data

Aug. 8, 1979 [JP] Japan ..... 54-109646

[51] Int. Cl.[5] ..... H01F 7/02; A61M 37/00; A61N 2/00

[52] U.S. Cl. ..... 335/306; 335/302; 600/12

[58] Field of Search ..... 600/9, 12

[56] References Cited

U.S. PATENT DOCUMENTS

| | | |
|---|---|---|
| 2,613,246 | 10/1952 | Spodig . |
| 3,005,458 | 10/1961 | Brook et al. . |
| 3,139,403 | 6/1964 | Cramer et al. . |
| 3,153,177 | 10/1964 | McFadyen . |
| 3,187,239 | 6/1965 | Rosenberger et al. . |
| 3,206,657 | 9/1965 | Moriya . |
| 3,376,529 | 4/1968 | Miyata . |
| 3,421,627 | 1/1969 | Lammers . |
| 3,462,720 | 8/1969 | Miyata . |
| 4,146,479 | 3/1979 | Brown . |

FOREIGN PATENT DOCUMENTS

| | | |
|---|---|---|
| 136851 | of 0000 | U.S.S.R. . |
| 812873 | 5/1959 | United Kingdom . |

OTHER PUBLICATIONS

Carroll, R. E., "Magnets in the Control of Traumatic Gastritis, a Preliminary Report", pp. 311-312, *J.A.V.-M.A.* (Oct. 19655).

Carroll, R. E., "The Use of Magnets in the Control of Traumatic Gastritis of Cattle", pp. 376-378, *J.A.V.M.A.* (Oct. 15, 1956).

Albright, J. L. et al., "Long-Term Effects of Magnets and Management in the Control of Traumatic Gastritis (Hardware Disease) in Large Commercial Dairy Herds", pp. 547-549, *Journal of Dairy Sciences* (Apr. 1962).

*Primary Examiner*—Leo P. Picard

[57] ABSTRACT

A magnet device for collecting scrap irons in the stomach that which cattle have swallowed into the stomach. The magnet device is constituted by a plurality of magnets and at least a magnetic plate interposed therebetween.

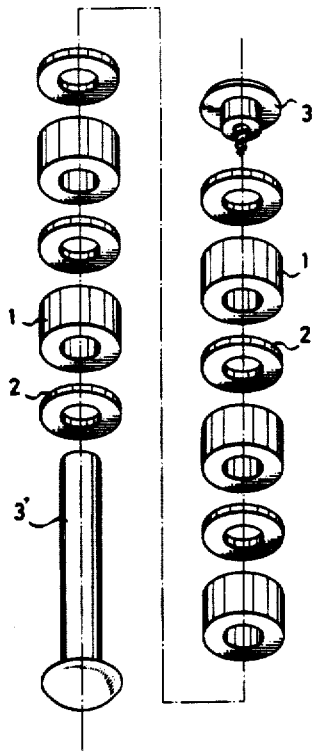

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-6 is confirmed.

* * * * *